United States Patent [19]

Wojaczek et al.

[11] Patent Number: 4,815,898

[45] Date of Patent: Mar. 28, 1989

[54] ROOF SUPPORTS

[75] Inventors: Egon Wojaczek, Hamm; Klaus Seeberger, Werne; Harry Rosenberg, Lüdinghausen; Wolfgang Stradtmann, Lünen, all of Fed. Rep. of Germany

[73] Assignee: Gewerkschaft Eisenhutte Westfalia GmbH, Lunen, Fed. Rep. of Germany

[21] Appl. No.: 93,262

[22] Filed: Sep. 4, 1987

[30] Foreign Application Priority Data

Sep. 9, 1986 [DE] Fed. Rep. of Germany ..... 3630579

[51] Int. Cl.[4] ..... E21D 15/44; E21D 17/054

[52] U.S. Cl. ..... 405/296; 405/291; 405/295

[58] Field of Search ..... 405/291–297; 299/33; 91/170 MP

[56] References Cited

U.S. PATENT DOCUMENTS

| | | | |
|---|---|---|---|
| 3,874,178 | 4/1975 | Kunzer | 405/295 |
| 4,231,684 | 11/1980 | Oppenlander et al. | 405/295 |
| 4,252,477 | 2/1981 | Bollmann | 405/296 |
| 4,609,308 | 9/1986 | Hill et al. | 405/291 X |

FOREIGN PATENT DOCUMENTS

| | | | |
|---|---|---|---|
| 3306585 | 9/1984 | Fed. Rep. of Germany | 405/295 |
| 3517347 | 11/1986 | Fed. Rep. of Germany | 405/296 |
| 0900004 | 2/1982 | U.S.S.R. | 405/296 |

*Primary Examiner*—Dennis L. Taylor

*Attorney, Agent, or Firm*—Sughrue, Mion, Zinn, Macpeak and Seas

[57] ABSTRACT

To increase the height of operation of a shield type roof support an attachment is fitted to the floor sill or to each of a pair of spaced-apart floor skids. The attachment has side walls with bores for receiving pivot pins used to link the attachment to the floor sill or skid and to guide levers connected to the goaf shield. A transverse body extends between the side walls and defines a socket for forming part of a ball-and-socket joint connecting the attachment to a hydraulic prop. The side walls of the attachment have under surfaces which rest on a support surface of the skid or sill near the working face.

12 Claims, 2 Drawing Sheets

ROOF SUPPORTS

BACKGROUND OF THE INVENTION

1. Field of the Invention

The present invention relates to mine roof supports and, more particularly, to supports with goaf shields provided with the so-called lemniscate or figure-of-eight guide system.

2. Description of Prior Art

Known supports for use in underground mine workings employ one or more hydraulic props flexibly connected with ball-and-socket joints between roof and floor-engaging structures. The floor-engaging structure may be a single sill or a sub-divided sill with individual floor skids. The floor structure is linked via pivot joints to guide levers which connect with further pivot joints to a goaf shield pivotably suspended from the roof structure. The floor structure has bores providing journal bearings for pivot pins and one or more bearing sockets for the prop or props. If the effective height of operation of the support is insufficient for the mine working, it is known to insert an attachment which is fitted onto the floor structure to provide an alternative higher seating for the prop or props and an alternative higher linkage for the guide levers. The seating for the prop or props may also be adjustable in height with the aid of special lifting brackets equipped to fit in the socket or prop bearing in the floor structure and having a new socket at some distance above for re-locating the prop. (See German Patent Specification No. 3 519 904). This arrangement permits the use of props with a stroke smaller than the desired height adjustment of the support and the tendency of longer props to buckle is thence precluded. The use of known forms of attachment nevertheless gives rise to problems since the attachment is invariably linked to the floor structure with just two connecting bolts or pins. Since the forces exerted on the goaf shield have to be transferred to the floor structure excessive stresses can occur on the connectors giving rise to failure.

A general object of the invention is to provide an improved support of the aforementioned kind and particularly a support which will enable high forces to be reliably transferred to the floor structure at all times.

SUMMARY OF THE INVENTION

A support constructed in accordance with the invention employs releasable means attachable to its floor-engaging structure to provide an alternative linkage between the goaf shield and the floor structure via the known figure-of-eight or lemniscate guide lever system and an alternative connection between the hydraulic prop or props and the floor structure overall to increase the effective height of opeation of the support. The invention is characterized by pivot pin connections for connecting the attachment means to the floor structure in conjunction with inter-engagable sliding support surfaces between the attachment means and the floor structure. The connections between the floor structure and the auxiliary structure, i.e. the attachment means, nearest the goaf, waste or stowage zone preferably provide firm fixed bearings, or supports while there is a much greater degree of free movement in any further connections spaced inwardly from the first-mentioned connections. These further connections provide non-load bearings which inhibit tilting of the auxiliary structure. The further connections may lie between the first connections and the sliding surfaces to provide relatively loose connections. The first connections between the floor and auxiliary structures in contrast provide firm bearings for transferring forces from the goaf shield via the guide levers and the auxilary structure to the main floor structure while the further connections and support surfaces form looser couplings or moveable bearings. This provides a statically determinable bearing arrangement which avoids the risk of overstraining and fracture of components.

Conveniently, the floor structure has bores forming journal bearings for pivot pins used either to connect the structure to the guide levers or else to the auxiliary structure or attachment means. The latter may then have bores for forming journal bearings for the pivot pins connections and additional bores for receiving further pins used to effect pivotal connection with the guide levers.

The support surfaces are preferably some distance apart from the fixed pivots in the direction of advancement. A most favourable force transmission between the attachment and the floor structure enables the attachment to be provided with a fixing bearing for the or each prop so that the forces on the prop can be transferred directly through to the floor structure. The bearing is best made in the form of a socket part of a ball-and-socket joint integral with the attachment and disposed immediately above the equivalent bearing or socket on the floor structure and between the sliding surfaces and the pivot connections.

Despite the considerable range over which the height of the support can be adjusted, props of moderate stroke can be used.

Where the floor structure is sub-divided into parallel floor skids each skid may locate with an attachment in accordance with the invention and the attachments on the skids may be interconnected with a flexible linkage or coupling holding the individual attachments a set distance apart.

The invention may be understood more readily, and various other aspects and features of the invention may become apparent, from consideration of the following description.

BRIEF DESCRIPTION OF DRAWINGS

An embodiment of the invention will now be described by way of example only, with reference to the accompanying drawings, wherein.

DESCRIPTION OF PREFERRED EMBODIMENT

Figure 1:
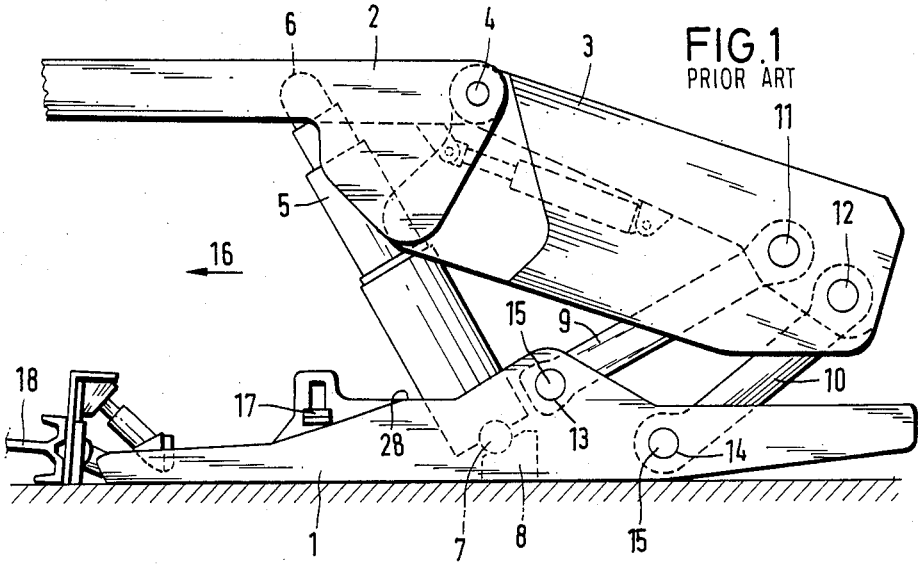
FIG.1 PRIOR ART
FIG. 1 is a schematic side view of a support of known type.
Figure 2:
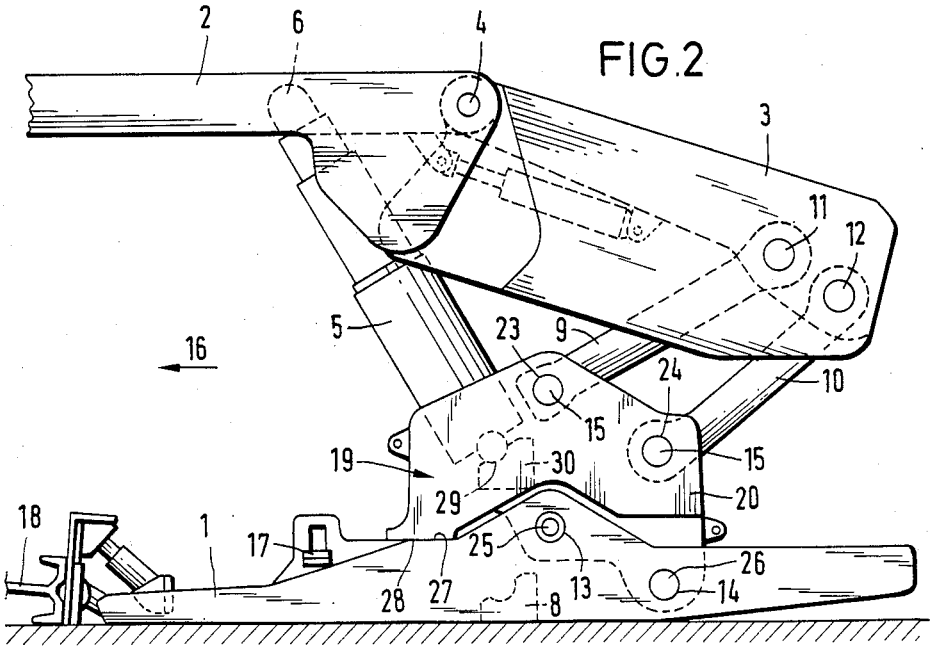
FIG. 2 is a schematic side view of the support modified in accordance with the invention.
Figure 3:
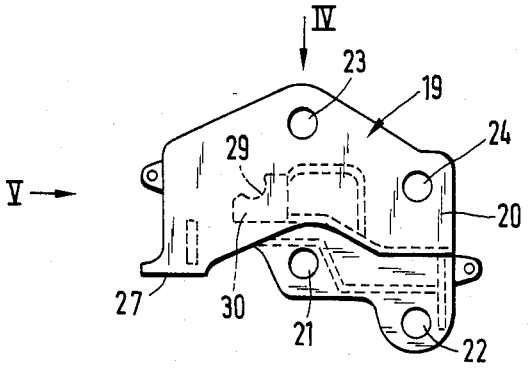
FIG. 3 is a side view of an auxiliary fitting structure used in the modified support.

FIG. 1 depicts a shield-type roof support of known design. The support is composed of a floor-engaging structure or sill 1, a roof-engaging structure 2, a shield 3 pivotably connected as at 4 to the rear end of the structure 2 and at least one hydraulic prop 5. The prop 5 is connected with a flexible connection 6 to the roof-engaging structure 2 and via a flexible connection 7 to the floor sill 1. The connections 6, 7 are preferably in the form of ball-and-socket joints and reference numeral 8 designate the socket part or bearing of the floor joint 7. The shield 3 is connected via guide levers 9, 10 to the floor sill 1. The shield 3 and the levers 9, 10 provide the so-called lemniscate or figure-of-eight guide system as known per se. The floor sill 1. is provided with journal bearings in bores 13, 14 which receive pivot pins 15 also passing through bores in the levers 9, 10. The bores and connectors 13, 14 are offset in the direction of advancement (arrow 16) and also vertically.

Figure 4:
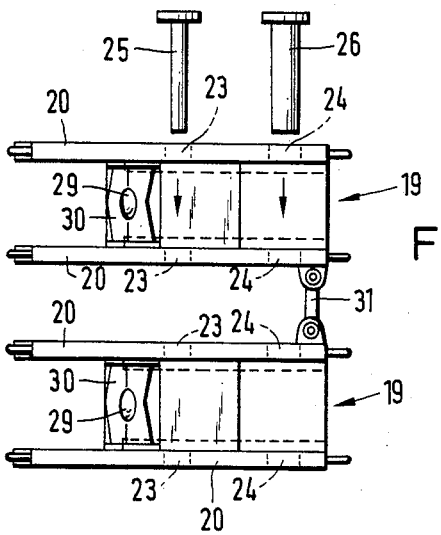
FIG. 4 is a plan view of the fitting taken in the direction of arrow IV of FIG. 3.

The floor sill 1 can be sub-divided in known manner to provide two parallel skids spaced apart and coupled together at the front ends with a connector 17 which fits in guide slots in the skids. This connection locates the skids a fixed distance apart laterally of the support but allows some vertical mobility between the skids. The subdivided sill 1 has floor skids of box-like form with two parallel side walls rigidly connected by transverse walls. An advancing mechanism is provided between the skids, usually a double-acting hydraulic ram, which interconnects the support to a scraper-chain conveyor 18. In the case of the sub-divided floor sill 1, each skid has its own connector 13, 14 linked to a pair of levers 9, 10 and each skid has its own socket part 8 of the ball-and-socket joint 7 for an associated prop 5. During use, the or each prop 5 is extended to raise the structure 2 into supportive contact with the roof of the mine working or retracted when the support is to be advanced. The effective height adjustment of the support brought about by extension and retraction of the prop(s) 5 is largely determined by the stroke of the prop(s) 5. To provide a greater height, auxiliary structure or fitting means providing one or more floor structure attachments is installed on the floor sill 1. In the case of the sub-divided sill 1 with the parallel floor skids the fitting means provides a pair of attachments and FIGS. 4 and 5 in particular show the use of such attachments 19 suitable for these spaced-apart skids. Each individual fitting or attachment 19 has two parallel side walls 20 rigidly interconnected by transverse walls. The walls 20 are provided with sets of bores 21, 22, 23, 24 which may be lined to provide journal bearings. The bores 21, 22 align with the bores 13, 14 of the skids of the sill structure 1 thus enabling the fittings 19 to be linked directly to the skids of the sill structure 1 with the aid of connecting pins 25, 26 after the levers 9, 10 have been released by extracting the pins 15. The front end regions of the walls 20 of each attachment 19 have lower support surfaces 27 which rest on surfaces 28 of the skids of the sill 1.

The levers 9, 10, are re-connected by means of the pins 15 to the fittings 19 with the pins 15 now locating in the upper bores 23, 24. Forces imparted to the shield 3 are transferred via the connections 15, 23, 15, 24 to the fittings 19 and thence to the skids. The connections at the goaf side of the sill structure 1 provided by the pins 26 and the bores 14 are fixed load bearings while the front support of the fittings 19 with the abutment surfaces 27, 28 form a loose movable bearings. It can be seen that as viewed in the direction of advance 16 the extent of the supporting surfaces 27 from the pivot connections 14, 26, is considerably greater than the distance between the bores 13 and 14 of the floor sill 1 linked to the levers 9, 10. The forces are thus transmitted at an ample distance apart via the fixed bearings 14, 26 and the movable bearings 27, 28 to the floor sill structure 1. The couplings provided by the pins 25 provide no great role in taking up forces between the fittings 19 and the floor sill structure 1 since the pins 25 are deliberately given considerably greater play in the bores 13, 21 than the pins 26 in the bores 14, 22. It is also possible to omit the pins 25 entirely. The pin couplings 25 however prevent tilting and ensure that under certain load conditions when the props are retracted the fittings 19 will not be displaced to move the surfaces 27, 28 apart.

Intermediate the surface(s) 27 and the bores 24, each fitting or attachment 19 incorporates a socket-like pivot bearing 29 corresponding to the socket bearing 8 of the sub-divided floor sill structure 1. These bearings 29 are directly above the bearings 8 when the attachments 19 are installed in place. Each bearing 29 mates with the base of the prop 5 associated therewith and consequently the prop forces likewise are transmitted to the floor skids via the attachments 19. As may be seen in particular from FIGS. 4 and 5, each pivot bearing 29 is formed by a body 30 occupying a fixed position between the walls 20 of the attachments 19.

Figure 5:
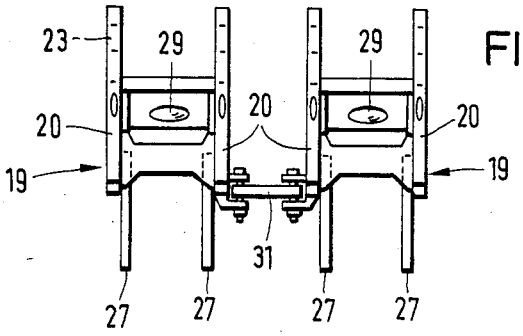
FIG. 5 is an end view of the fitting, the view being taken in the direction of arrow V of FIG. 3.

FIG. 5 shows that the attachments 19 affixed in the aforementioned manner to the two floor skids of the subdivided floor sill 1 are themselves interconnected in the rear zone, i.e. in the zone of the stowage or goaf guide lever connecting bores 24, via a rigid coupling element 31. The coupling element 31 is connected via upstanding pivot pins with the facing walls 20 of the attachments 19.

Where the sill structure 1 is undivided, a single attachment 19 generally as described but with one or more pivot bearings 29 for the prop or props 5 can be used.

We claim:

1. In a roof support for use in mineral mining comprising a floor-engaging structure, a roof-engaging structure, at least one hydraulic prop, means for flexibly connecting the prop to the roof and floor-engaging structures, a goaf shield, means pivotably connecting the goaf shield to the roof-engaging structure and guide levers pivotably interconnecting the goaf shield to the floor-engaging structure; the improvement comprising releasable means attachable to the floor-engaging structure to provide an alternative linkage between the guide levers and the floor-engaging structure and an alternative connection between the prop and the floor-engaging structure to increase the effective height of operation of the support, pivot pin connections for connecting the attachment means to the floor-engaging structure with differental clearance relative to their positions and inter-engaging slidable complementary surfaces of the attachment means and the floor-engaging structure over a zone spaced from the pivot pin connections.

2. A support according to claim 1, wherein the floor-engaging structure has bores for forming journal bearings for pivot pins used to connect the structure to the guide levers and in the alternative to the attachment means.

3. A support according to claim 1, wherein the floor-engaging structure is composed of two parallel floor skids and the attachable means comprises a pair of similiar fittings connected with the pivot pin connections and the slidable surfaces to the individual skids.

4. A support according to claim 1, wherein the attachable means has bores for forming journal bearings for said pivot pin connections and additional bores for receiving further pins for effecting pivotal connection with the guide levers.

5. A support according to claim 3, wherein the fittings are interconnected by a transverse link and pivot joints.

6. A support according to claim 1, wherein the pivot pin connections include pivot pins offset from one another in at least two directions.

7. A support according to claim 1, wherein the pivot pins connections include first pivot pins intermediate other pivot pins and the slidable support surfaces, the first pins having a greater degree of free play than said other pins.

8. A support according to claim 1, wherein the attachment means has a socket forming a bearing for locating said prop, the socket being located above a similiar socket provided on the floor-engaging structure.

9. A support according to claim 8, wherein the socket of the attachment means is disposed between the slidable surfaces and the pivot pins connections.

10. A support according to claim 8, wherein the socket of the attachment means is provided in a transverse body fixed between a pair of side walls provided with bores for the pivot pin connection and with lower surfaces forming part of the slidable surfaces.

11. A support according to claim 1, wherein the pivot pins connections comprise first connections positioned adjacent a rear end of the support nearest the goaf zone and remote from a mineral face and further connections intermediate the first connections and the slidably engagable surfaces and wherein the further connections have a greater freedom of movement than the first connections.

12. In a roof support for use in mineral mining comprising a floor-engaging structure, a roof-engaging structure, at least one hydraulic prop, means for flexibly connecting the prop to roof and floor-engaging structures, a goaf shield, means pivotably connecting the goaf shield to the roof-engaging structure and guide levers pivotably interconnecting the goaf shield to the floor-engaging structure; the improvement comprising auxiliary structure releasably attachable to the floor-engaging structure to provide an alternative linkage between the guide levers and the floor-engaging structure and an alternative connection between the prop and the floor-engaging structure to increase the effective height of operation of the support, pivot pin connections for connecting the attachment means to the floor-engaging structure and inter-engaging slidable complementary surfaces of the attachment means and the floor-engaging structure over a zone spaced from the pivot pin connections.

* * * * *